US008172362B2

(12) United States Patent
Sakakitani

(10) Patent No.: US 8,172,362 B2
(45) Date of Patent: May 8, 2012

(54) IMAGE RECORDING APPARATUS

(75) Inventor: Masatoshi Sakakitani, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 97 days.

(21) Appl. No.: 12/397,887

(22) Filed: Mar. 4, 2009

(65) Prior Publication Data

US 2009/0278886 A1 Nov. 12, 2009

(30) Foreign Application Priority Data

Mar. 5, 2008 (JP) ..... 2008-054336

(51) Int. Cl.
*B41J 2/165* (2006.01)

(52) U.S. Cl. ..... 347/36

(58) Field of Classification Search ..... None
See application file for complete search history.

(56) References Cited

U.S. PATENT DOCUMENTS

| | | | | |
|---|---|---|---|---|
| 3,983,888 | A * | 10/1976 | Edwards | 134/9 |
| 6,827,412 | B2 * | 12/2004 | Inui et al. | 347/7 |
| 6,846,061 | B2 * | 1/2005 | Nakashima | 347/22 |
| 7,419,241 | B2 | 9/2008 | Kawashima et al. | |
| 2005/0194730 | A1 | 9/2005 | Nishida et al. | |
| 2006/0050104 | A1 | 3/2006 | Sakakitani | |
| 2007/0013735 | A1 | 1/2007 | Sakakitani | |
| 2007/0146461 | A1 * | 6/2007 | Islam et al. | 347/103 |
| 2008/0117253 | A1 * | 5/2008 | Yearout et al. | 347/36 |
| 2008/0225068 | A1 | 9/2008 | Morino et al. | |

FOREIGN PATENT DOCUMENTS

| | | |
|---|---|---|
| JP | 2001-162836 | 6/2001 |
| JP | 3434174 | 5/2003 |
| JP | 2003-320690 | 11/2003 |
| JP | 2005-119210 | 5/2005 |
| JP | 2005-199598 | 7/2005 |
| JP | 2007-144838 | 6/2007 |

* cited by examiner

*Primary Examiner* — Matthew Luu
*Assistant Examiner* — Alejandro Valencia
(74) *Attorney, Agent, or Firm* — Cooper & Dunham LLP

(57) ABSTRACT

An image recording apparatus includes an idle ejection receiving part for receiving idle-ejected waste liquid from a liquid jet head and a waste liquid tank provided below the idle ejection receiving part for collecting the waste liquid dropping from the idle ejection receiving part. The image recording apparatus further includes a rotating member having a peripheral surface for rotating and receiving the waste liquid, and a wiping member that contacts or faces the peripheral surface for wiping the waste liquid on the peripheral surface of the rotating member. The wiping member is configured to move in a peripheral direction of the rotating member.

16 Claims, 16 Drawing Sheets

IMAGE RECORDING APPARATUS

BACKGROUND OF THE INVENTION

1. Technical Field

This disclosure relates to an image recording apparatus for recording images by ejecting liquid droplets from a liquid jet head onto a recording medium.

2. Description of the Related Art

Japanese Laid-Open Patent Publication Nos. 2001-162836 and 2003-320690 each disclose an image recording apparatus for recording images by ejecting liquid droplets from a liquid jet head onto a recording medium. Each of these image recording apparatuses includes an idle ejection receiving portion having a roller (rotating member) for rotating and receiving idle-ejected waste liquid (waste liquid not intended to form images) not on its peripheral surface and a wiping member for wiping off the waste liquid adhered to the roller.

BRIEF SUMMARY OF THE INVENTION

In an aspect of this disclosure, there is provided an image recording apparatus including an idle ejection receiving part for receiving idle-ejected waste liquid from a liquid jet head and a waste liquid tank provided below the idle ejection receiving part for collecting the waste liquid dropping from the idle ejection receiving part, the image recording apparatus including: a rotating member having a peripheral surface for rotating and receiving the waste liquid; and a wiping member that contacts or faces the peripheral surface for wiping the waste liquid on the peripheral surface of the rotating member; wherein the wiping member is configured to move in a peripheral direction of the rotating member.

The aforementioned and other aspects, features and advantages will become more apparent from the following detailed description when read in conjunction with the accompanying drawings.

DETAILED DESCRIPTION OF THE PREFERRED EMBODIMENTS

With the wiping member according to the above-described Japanese Laid-Open Patent Publication Nos. 2001-162836 and 2003-320690, because the wiping member is fixed to a certain position, the area that can wiped by the wiping member is limited to a certain area. Accordingly, the wiped waste liquid dropping from the idle ejection liquid tank concentrates at a certain area in a waste liquid tank situated below the idle ejection receiving part. In a case where the waste liquid has high viscosity or where the density of the solvent of the waste liquid inside the waste liquid tank is low, the waste liquid accumulates at the certain area in the waste liquid tank. This causes the accumulated waste liquid to flow out from the waste liquid tank before the waste liquid in the waste liquid tank exceeds the capacity of the waste liquid tank.

With the below-described embodiments of the present invention, waste ink (waste liquid) can be prevented from accumulating at a single area in a waste liquid tank by changing the position of a blade (wiping member) for wiping the waste ink by moving the blade along a peripheral direction of a roller (rotating member). Accordingly, waste ink can be prevented from flowing out of the waste liquid tank before the waste ink collected in the waste liquid tank exceeds the capacity of the waste liquid tank.

In the following, embodiments of the present invention will be described with reference to the accompanying drawings.

Figure 1:
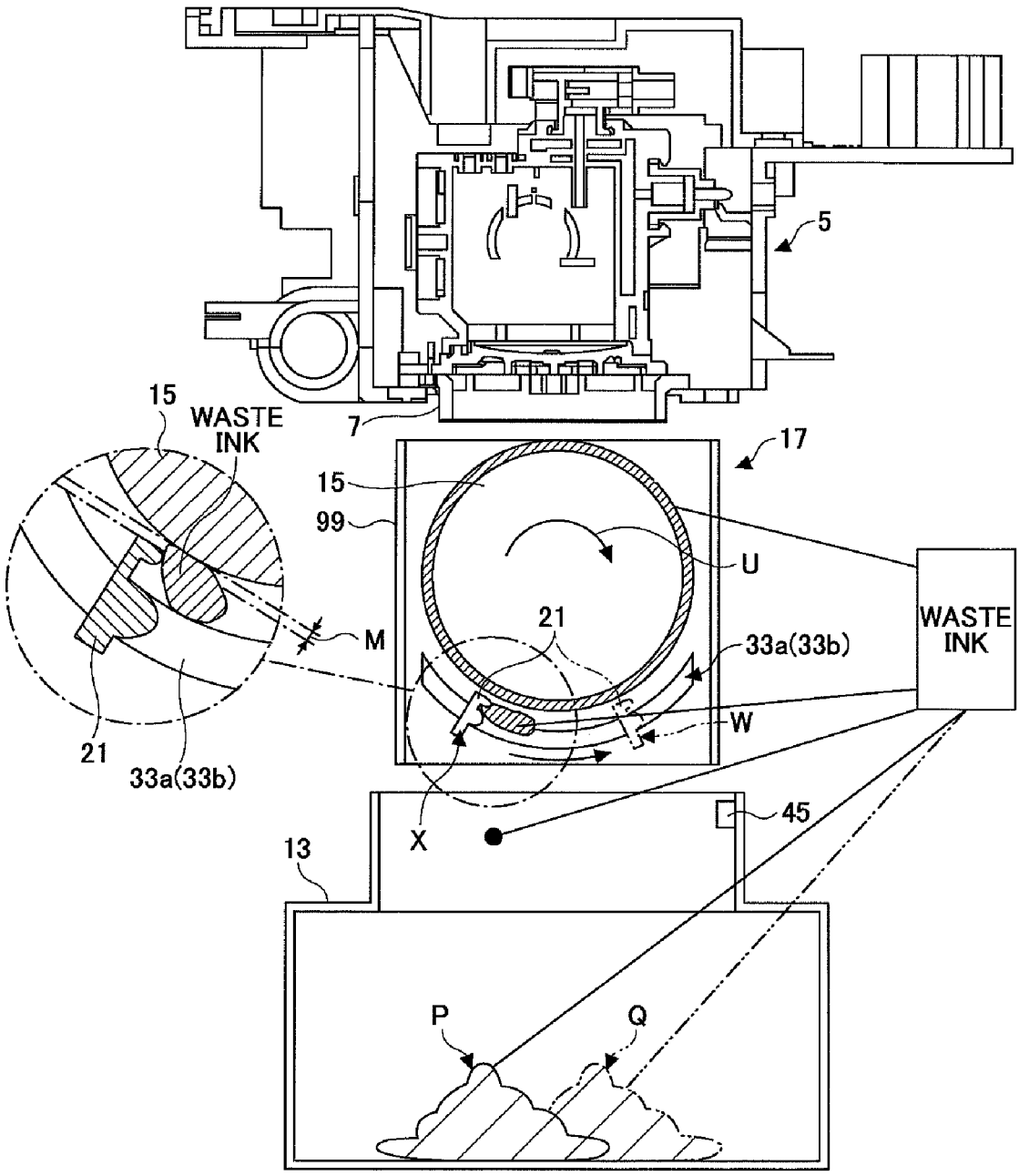
FIG. 1 is a vertical cross-sectional diagram for describing the surrounding of an idle ejection receiving part in a case where an idle ejection operation (operation of ejecting liquid (ink) not intended to form images) is being performed in an image recording apparatus according to an embodiment of the present invention.
Figure 2:
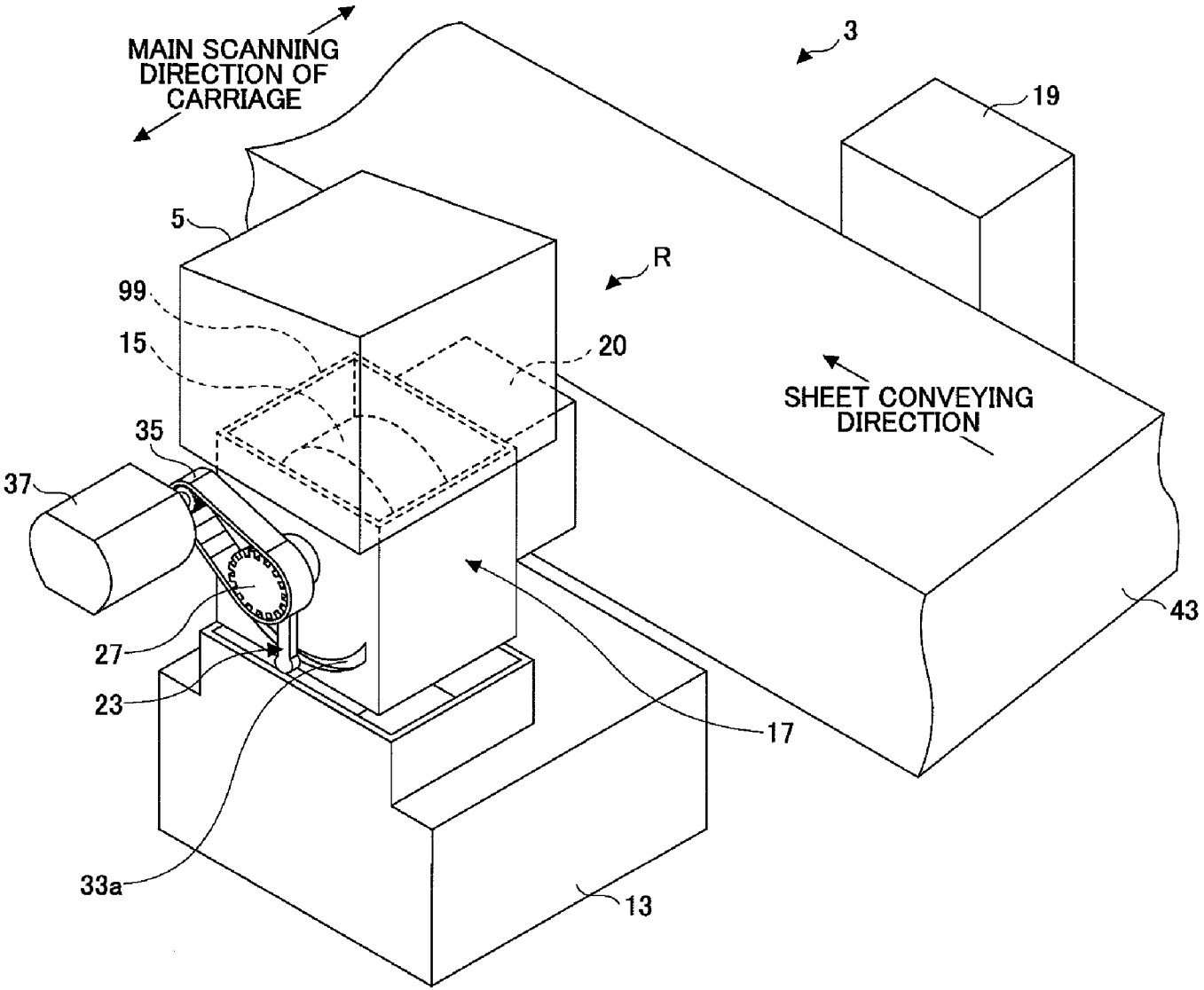
FIG. 2 is a perspective view for describing the surrounding of the idle ejection receiving part in a case where an idle ejection operation is being performed in the image recording apparatus according to an embodiment of the present invention.
Figure 3:
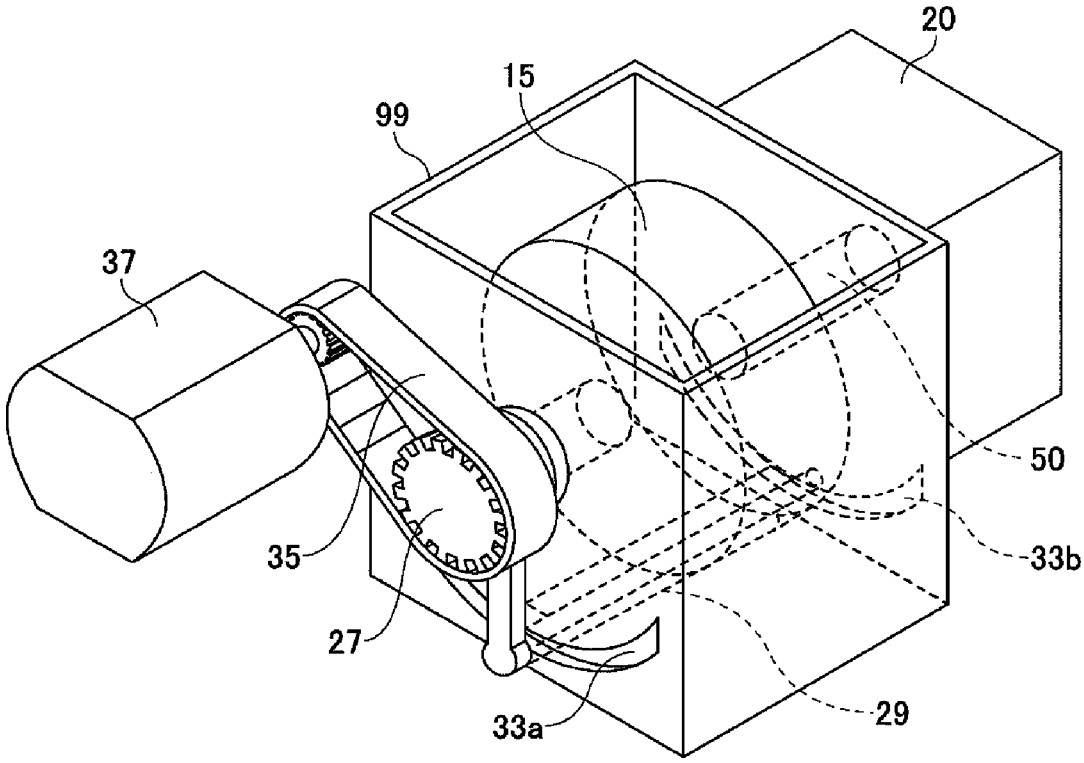
FIG. 3 is a perspective view illustrating a configuration of the idle ejection receiving part of the image recording apparatus according to an embodiment of the present invention.
Figure 4:
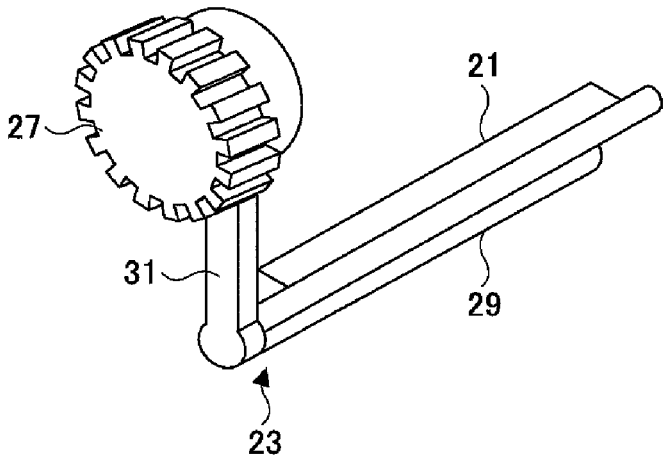
FIG. 4 is a perspective view illustrating a joining of a blade, an arm, and a gear of the idle ejection receiving part according to an embodiment of the present invention.
Figure 5:
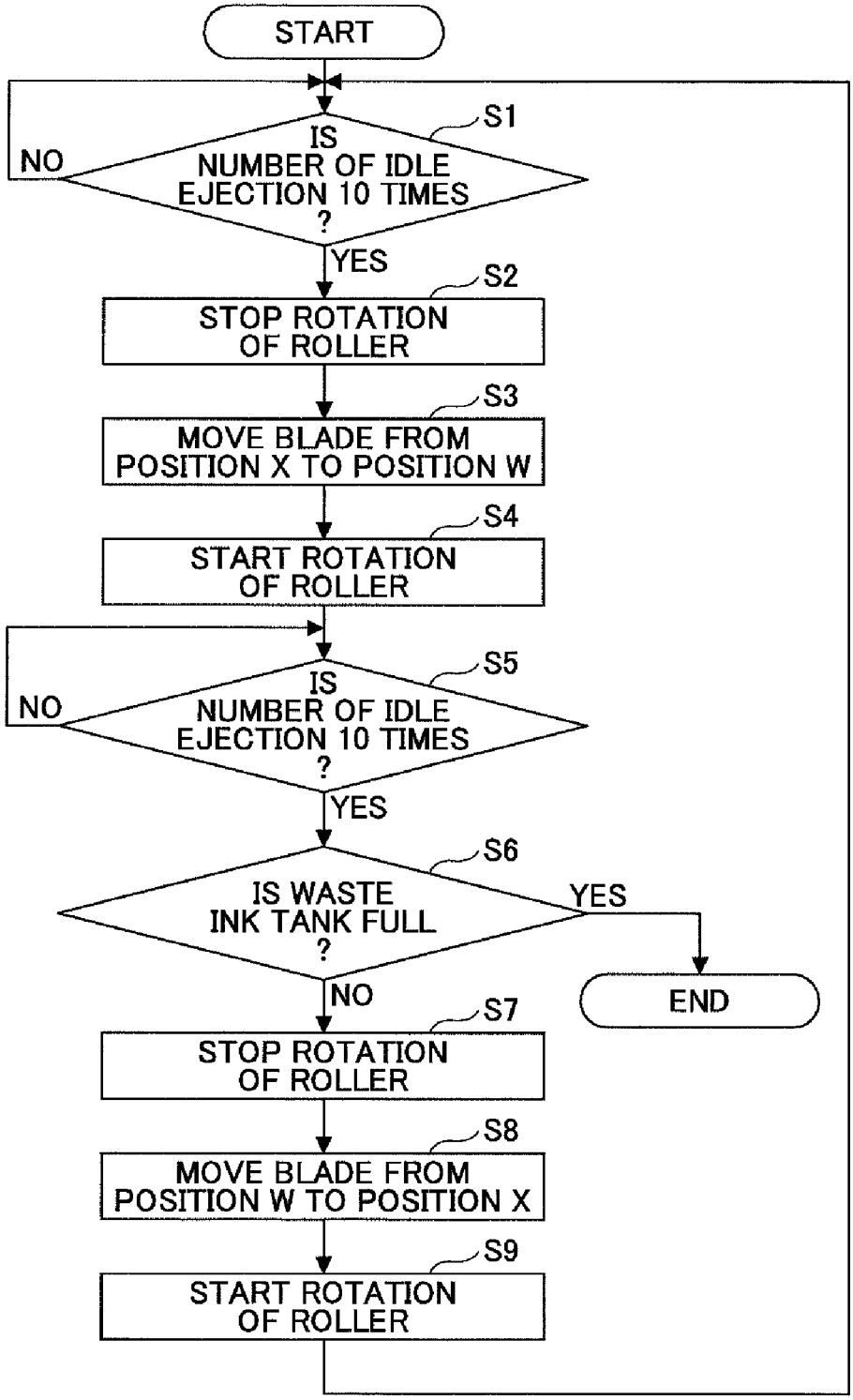
FIG. 5 is a flowchart illustrating an operation (flow) for controlling the idle ejection receiving part according to an embodiment of the present invention.
Figure 6:
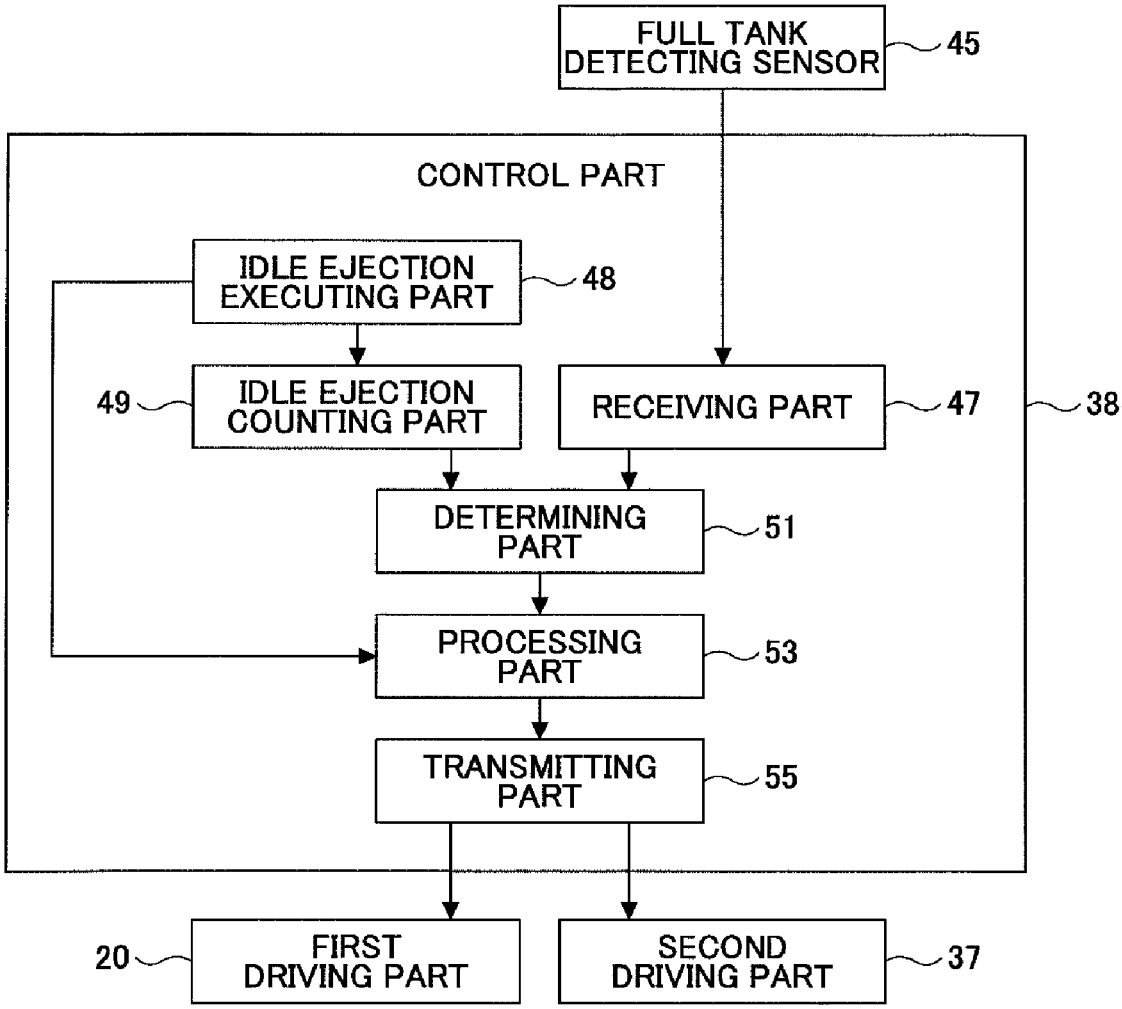
FIG. 6 is a block diagram illustrating a configuration of a control part of the image recording apparatus according to an embodiment of the present invention.
Figure 7:
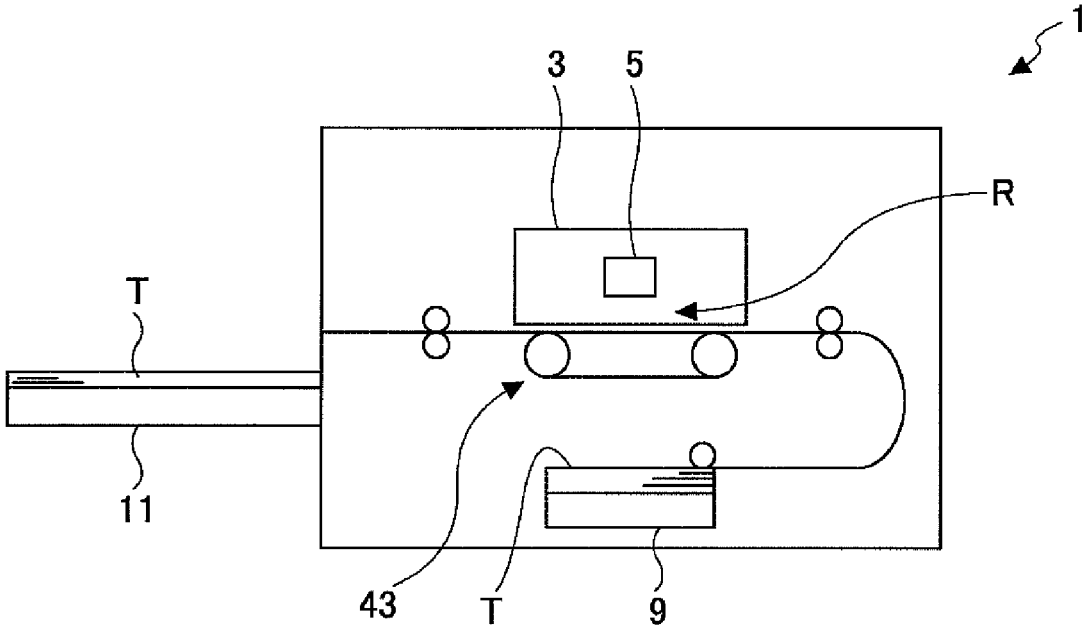
FIG. 7 is a vertical cross-sectional view illustrating a configuration of the image recording apparatus according to an embodiment of the present invention.

FIG. 1 is a vertical cross-sectional diagram for describing the surrounding of an idle ejection receiving part 17 in a case where an idle ejection operation is being performed in an image recording apparatus 1 according to an embodiment of the present invention. FIG. 2 is a perspective view for describing the surrounding of the idle ejection receiving part 17 in a case where an idle ejection operation is being performed in the image recording apparatus 1 according to an embodiment of the present invention. FIG. 3 is a perspective view illustrating a configuration of the idle ejection receiving part 17 of the image recording apparatus 1 according to an embodiment of the present invention. FIG. 4 is a perspective view illustrating a joining of a blade, an arm, and a gear of the idle ejection receiving part 17 according to an embodiment of the present invention. FIG. 5 is a flowchart illustrating an operation (flow) for controlling the idle ejection receiving part 17 according to an embodiment of the present invention. FIG. 6 is a block diagram illustrating a configuration of a control part 38 of the image recording apparatus 1 according to an embodiment of the present invention. FIG. 7 is a vertical cross-sectional view illustrating a configuration of the image recording apparatus 1 according to an embodiment of the present invention.

First Embodiment

In this embodiment, the image recording apparatus 1 is a printer. As illustrated in FIG. 7, the image recording apparatus 1 includes a recording part 3 for recording an image by ejecting highly viscous ink (liquid) onto a sheet(s) of paper T (recording medium), a sheet feed part for feeding the paper T to the recording part 3, and a sheet discharging part for discharging the paper T having an image recorded thereon by the recording part 3.

As illustrated in FIGS. 1 and 2, the recording part 3 includes a carriage 5 having an inkjet head (liquid jet head) 7, the idle ejection receiving part 17 for receiving idle-ejected ink (waste ink) (i.e. ink not intended for forming images) discarded from the inkjet head 7 during an idle ejection operation (ejection of liquid (ink) not intended to form images), and a waste liquid tank 13 for collecting the waste ink (i.e. the ink ejected by the idle ejection by the inkjet head 7). Further, the recording part 3 also includes an ink tank (not illustrated) for storing ink to be supplied to the ink jet head 7, a maintenance/recovery unit 19 for conducting maintenance and recovery of the inkjet head 7, and a conveying part 43 for conveying the paper T.

As illustrated in FIG. 2, the carriage 5 is for moving the inkjet head 7 in the main scanning direction. The carriage 5 has a sub-tank (not illustrated) installed for supplying ink to the inkjet head 7. The sub-tank supplies ink from the ink tank to the inkjet head 7 via an ink tube.

The inkjet head 7 is for recording an image(s) on the paper T by ejecting ink onto the paper from one or more of its nozzles (not illustrated). The inkjet head 7 receives ink supplied from the sub-tank installed in the carriage 5.

The conveying part 43 is positioned between the idle ejection receiving part 17 and the maintenance/recovery unit 19. The carriage 5 moves to a position facing the idle ejection receiving part 17 for allowing the inkjet head 7 to conduct the idle ejection operation (ejection of liquid (ink) not intended to form images). Further, the carriage 5 moves to a position facing the maintenance/recovery unit 19 for allowing the inkjet head 7 to conduct a maintenance/recovery operation.

As illustrated in FIG. 1, the idle ejection receiving part 17 includes a housing 99. A roller (rotating member) 15 for rolling and receiving idle-ejected ink (waste ink) on its peripheral surface and a blade (wiping member) 21 for wiping off the waste ink adhered to the peripheral surface of the roller 15 are provided inside the housing 99. In this embodiment, the blade 21 is made of metal. The housing 99 is shaped as a rectangular parallelpiped having its top and bottom surfaces open.

As illustrated in FIG. 3, the roller 15 is supported by a driving axle extending in a direction orthogonal to the sheet conveying direction (i.e. a direction substantially parallel to the main scanning direction of the carriage 5) and is driven at a constant rate in a direction indicated with an arrow U as illustrated in FIG. 1 by a motor (hereinafter also referred to as "first driving part") 20. The first driving part 20 is controlled by the below-described control part 38.

As illustrated in FIG. 4, the blade 21 is attached to a first straight part 29 of an L-shaped arm 23. The first straight part 29 is connected to one end of a second straight part 31 of the arm 23. The other end of the second straight part 31 is fixed to a gear 27.

As illustrated in FIG. 3, the first straight part 29 is inserted into elongated holes 33*a*, 33*b*. The elongated holes 33*a*, 33*b* are formed at the sides of the housing 99 so that one faces the other. In this embodiment, the elongated holes 33*a*, 33*b* have an arcuate shape and are positioned below the roller 15 and along a peripheral direction of the roller 15. As illustrated in FIG. 1, the elongated holes 33*a*, 33*b* have substantially the same curvature as that of the roller 15.

That is, the blade 21 is positioned substantially parallel to the axis of the roller 15 and facing the peripheral surface of the roller 15. As illustrated in FIG. 1, a space (gap) M is provided between the blade 21 and the peripheral surface of the roller 15.

The gear 27 is fixed to an axle 50 provided at a center part of the roller 15. The axle 50 is rotatably fixed to the roller 15. The gear 27 is driven by a first stepping motor (hereinafter also referred to as "second driving part") 37 via a timing belt 35. The second driving part 37 is capable of rotating in both forward and backward directions. The second driving part 37 is also controlled by the below-described control part 38.

The blade 21 is driven by the second driving part 37 to move between a position X and position W (see FIG. 1) along the peripheral surface of the roller 15. In this embodiment, the position X and the position W are the positions where the blade 21 stops (stop positions).

The waste ink tank 13 is positioned directly below the idle ejection receiving part 17. The waste ink tank 13 has an opening only at its upper part for collecting waste ink falling from the idle ejection receiving part 17. A full tank detecting sensor (optical sensor) 45 is provided at the upper part of the waste liquid tank 13 for detecting whether the waste liquid tank 13 is full.

The maintenance/recovery unit 19 has a maintenance/recovery part at its upper part and a discharge part at its lower part. The maintenance recovery part includes, for example, a suction cap for suctioning unnecessary ink adhered to the nozzle of the inkjet head. The discharge part collects ink that is suctioned by the auctioning cap or the waste ink that is idle-ejected from the inkjet head 7.

The conveying part 43 is for intermittently conveying the paper T to a recording area R. In this embodiment, the conveying part 43 includes a conveyor belt wound around a driving roller and a driven roller.

As illustrated in FIG. 6, the control part 38 includes a receiving part 47 for receiving detection signals from the full tank detecting sensor 45, an idle ejection executing part 48 for enabling the inkjet head 7 to execute idle ejection not intended to form images, an idle ejection counting part 49 for counting the number of times the idle ejection is executed, a determining part 51 for determining the status of the waste liquid tank 13 according to the detection signals from the receiving part 47 and the status of the number of times of idle-ejection execution according to the idle ejection counting part 49, a processing part 53 for performing various processes according to determination results from the determining part 51 or idle ejection execution signals from the idle ejection executing part 48, and a transmitting part 55 for transmitting the process results of the processing part 53 to the first and second driving parts 20, 37.

Next, an operation of the image recording apparatus 1 according to an embodiment of the present invention is described with reference to FIG. 7. Upon receiving a signal to start a sheet feeding process (sheet feed start signal) according to controls of, for example, a computer, the paper T is conveyed from the sheet feeding part 9 to the recording area R below the recording part 3. After the paper 7 is conveyed to the recording area R, an image is recorded to the paper T by ejecting ink from the inkjet head 7 onto the paper T while intermittently feeding the paper T with the conveying part 9 and moving the carriage 5 in the main scanning direction. After the image is recorded onto the paper T, the paper T is discharged from the sheet discharging part 11.

The inkjet head 7 periodically performs the idle ejection operation with the idle ejection receiving part 17 and the maintenance/recovery operation with the maintenance/recovery unit 19 at intervals of a recording operation.

Next, the idle ejection operation by the inkjet head 7 is described with reference to FIG. 1. When an idle ejection execution signal is input to the processing part 53 from the idle ejection executing part 48, the motor 20 is driven for starting the rotation of the roller 15. The waste ink that is idle-ejected from the inkjet head 7 adheres to the peripheral surface of the rotating roller 15 and is wiped off by the blade 21 when reaching the position of the blade 21. The blade 25 is initially located at the position X. Thus, the wiped off waste ink falls to a position P in the waste liquid tank 13 located directly below the position X and accumulates at the position P.

Next, an embodiment of an operation (flow) for controlling the idle ejection receiving part 17 is described with reference to FIG. 5. First, the determining part 51 determines whether the number of times of the idle ejection execution (counted idle-ejection execution number) counted by the idle ejection counting part 49 has reached a predetermined number of times (in this embodiment, 10 times). In a case where the determining part 51 determines that the counted idle-ejection execution number has not reached 10 times (No in Step S1), the determining part 51 repeats determining whether the counted idle-ejection execution number has reached 10 times. In a case where the determining part 51 determines that the counted idle-ejection execution number has reached 10 times (Yes in Step S1), the processing part 53 stops the rotation of the roller 15 (Step S2). Then, after the processing part 53 moves the blade 21 from the position X to the position W by rotating the first stepping motor 37 in a forward direction (Step S3), the rotation of the roller is started (Step S4). It is to be noted that, in this embodiment, the idle-ejection operation is not performed during a period where the rotation of the roller 15 is stopped. When the blade 21 is in the position W, the waste ink wiped off from the blade 21 falls to a position Q in the waste liquid tank 13. Then, the determining part 51 again determines whether the counted idle-ejection execution number has reached 10 times (Step S5). In a case where the determining part 51 determines that the counted idle-ejection execution number has reached 10 times (Yes in Step S5), the determining part 51 determines whether the waste liquid tank 13 is full based on detection results of the full tank detecting sensor 45 (Step S6). In a case where the determining part 51 determines that the counted idle-ejection execution number has not reached 10 times (No in Step S5), the determining part 51 repeats determining whether the counted idle-ejection execution number has reached 10 times (Step S5). In a case where the determining part 51 determines that the waste liquid tank 13 is full (Yes in Step S6), the operation of FIG. 5 is terminated. In a case where the determining part 51 determines that the waste liquid tank 13 is not full (No in Step S6), the processing part 53 stops the rotation of the roller 15 (Step S7). Then, after the blade 21 is moved from the position W to the position X by rotating the first stepping motor 37 in a reverse direction (Step S8), the rotation of the roller is started (Step S9). Then, the operation returns to Step S1.

With the above-described embodiment of the present invention, the waste ink (waste liquid) can be prevented from accumulating at a single area in the waste liquid tank 13 by changing the position of the blade 21 for wiping the waste ink by moving the blade (wiping member) 21 along a peripheral direction of the roller (rotating member) 15. Accordingly, waste ink can be prevented from flowing out of the waste liquid tank 13 before the waste ink collected in the waste liquid tank 13 exceeds the capacity of the waste liquid tank 13.

In the above-described embodiment, since the control part 38 changes the position of the blade 21 when the number of times of executing the idle-ejection operation reaches a predetermined number (e.g., 10 times), the waste ink can be automatically prevented from accumulating at a certain part in the waste liquid tank 13.

Second Embodiment

Figure 8:
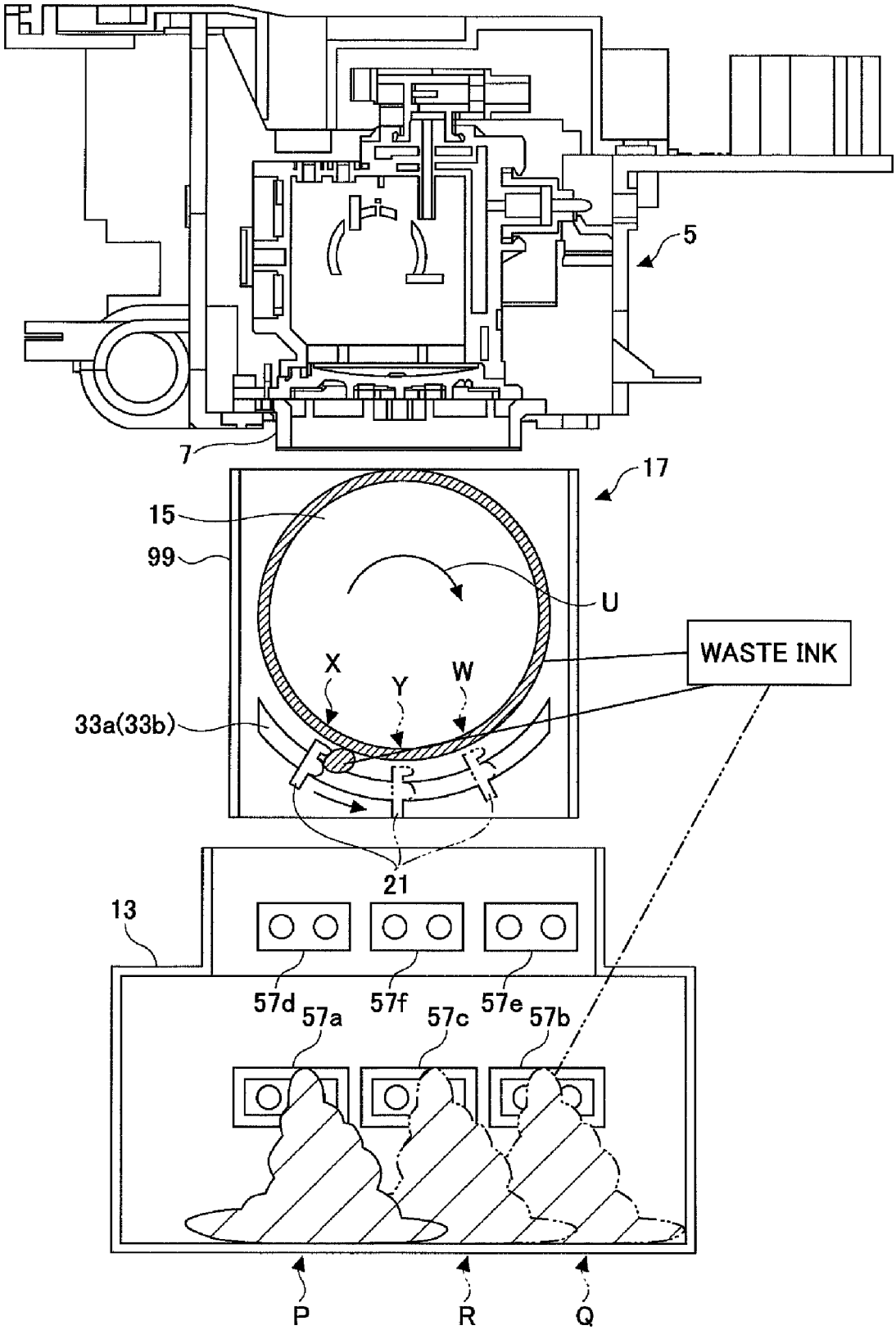
FIG. 8 is a vertical cross-sectional diagram for describing the surrounding of an idle ejection receiving part in a case where an idle ejection operation is being performed in an image recording apparatus according to a second embodiment of the present invention.
Figure 9:
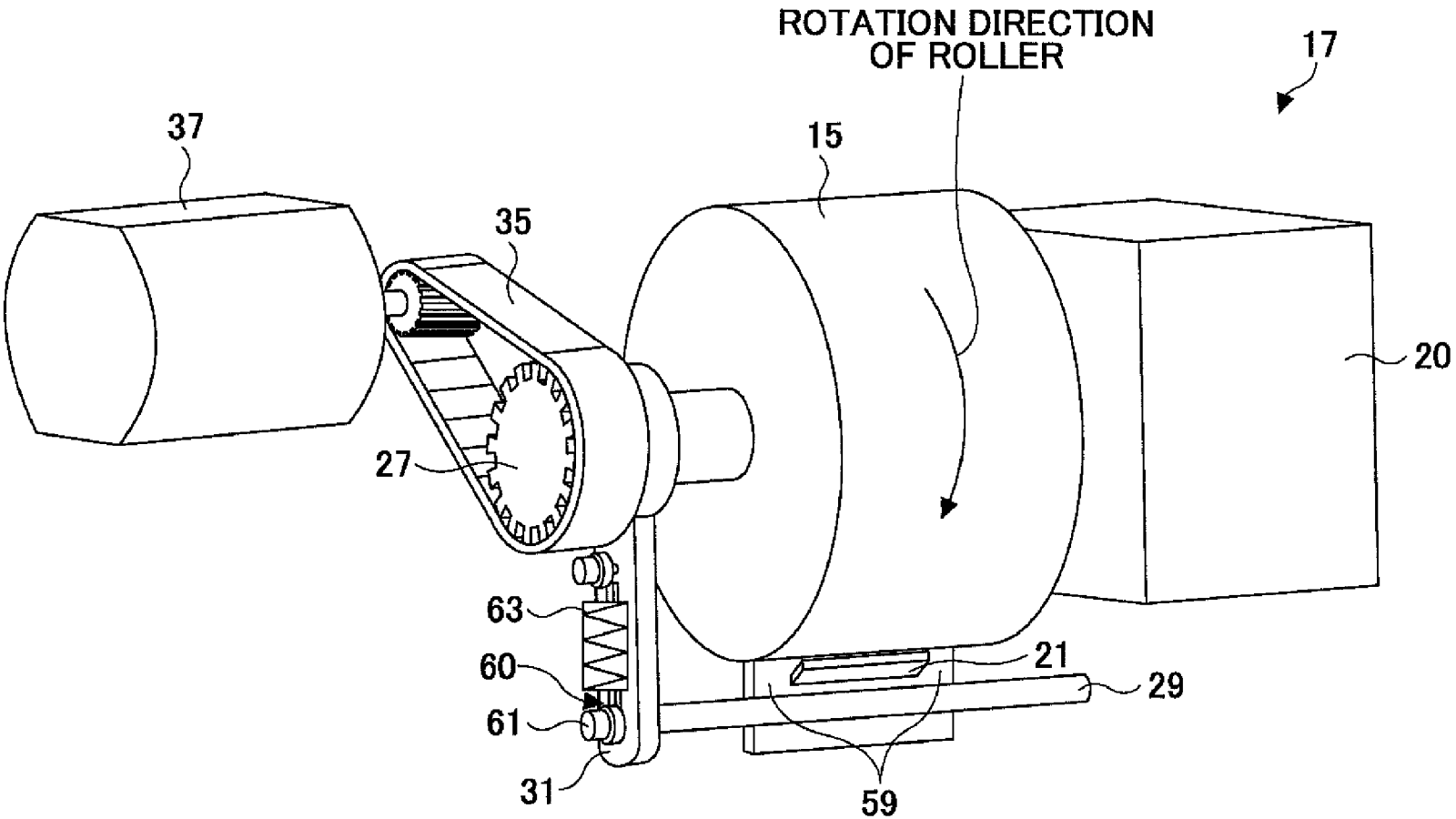
FIG. 9 is a perspective view illustrating an idle ejection receiving part according to the second embodiment of the present invention.
Figure 10:
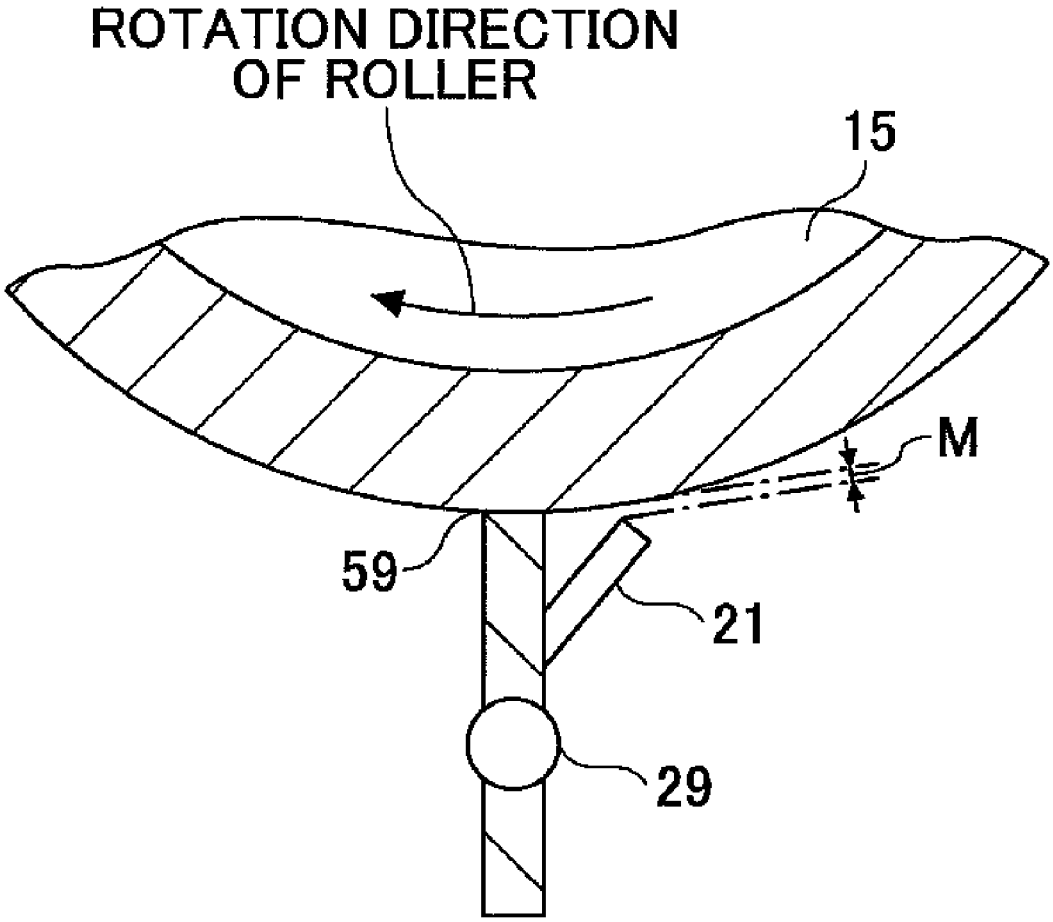
FIG. 10 is a vertical cross-sectional diagram for describing contact between a contacting part and a peripheral surface of a roller in an idle ejection receiving part according to the second embodiment of the present invention.
Figure 11:
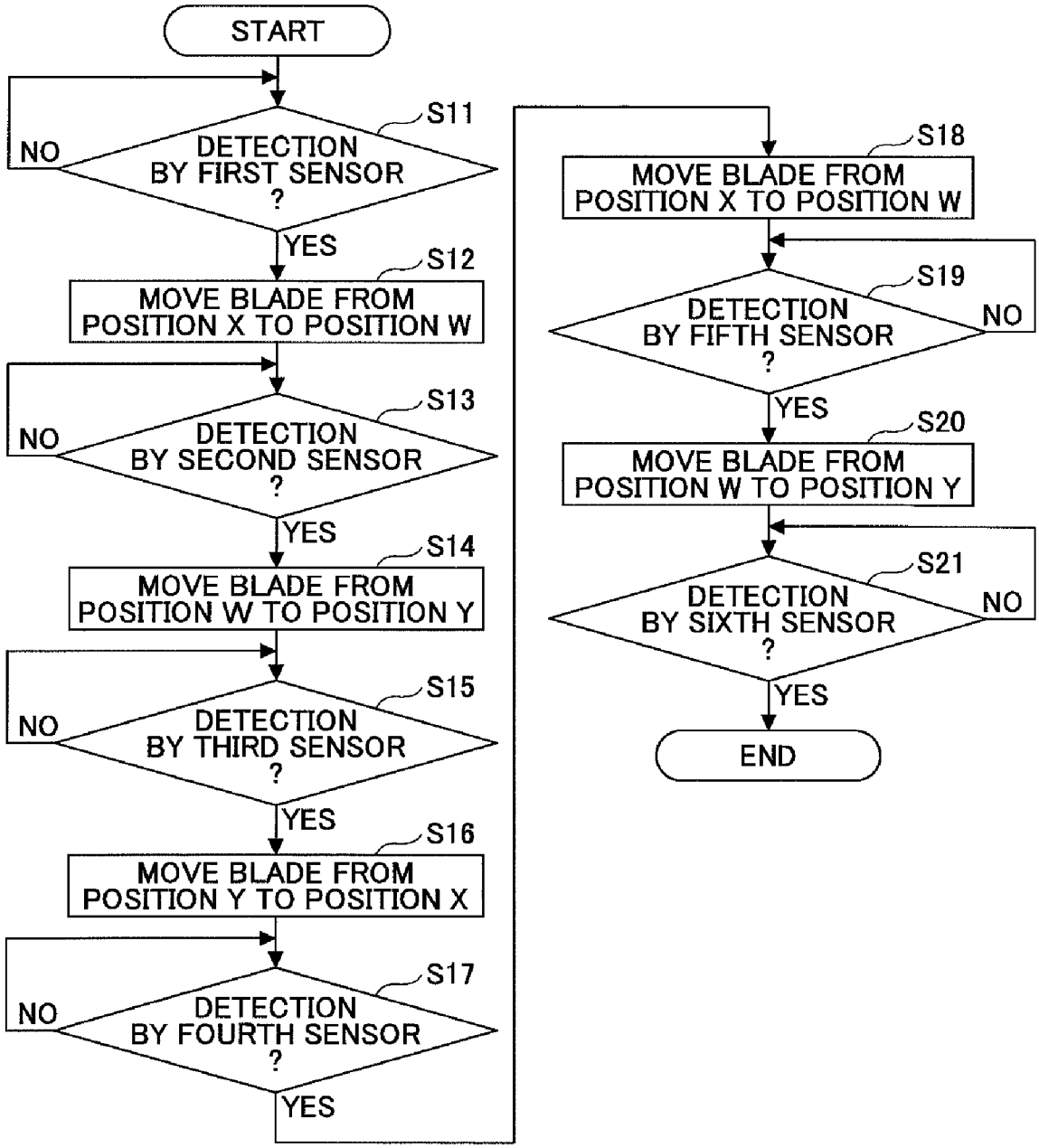
FIG. 11 is a flowchart illustrating an operation (flow) for controlling an idle ejection receiving part according to the second embodiment of the present invention.

Next, an image recording apparatus according to a second embodiment of the present invention is described with reference to FIGS. 8-10. In the second embodiment, like components are denoted by like reference numerals as of the first embodiment and are not further described. FIG. 8 is a vertical cross-sectional diagram for describing the surrounding of an idle ejection receiving part 17 in a case where an idle ejection operation (operation of ejecting liquid (ink) not intended to form images) is being performed in an image recording apparatus 1 according to a second embodiment of the present invention. FIG. 9 is a perspective view illustrating the idle ejection receiving part 17 according to the second embodiment of the present invention. FIG. 10 is a vertical cross-sectional diagram for describing contact between a contacting part 59 and a peripheral surface of the roller 15 in the idle ejection receiving part 17 according to the second embodiment of the present invention. FIG. 11 is a flowchart illustrating an operation (flow) for controlling the idle ejection receiving part 17 according to the second embodiment of the present invention.

In the second embodiment, a first sensor (first waste liquid sensor) 57*a*, a second sensor (second waste liquid sensor) 57*b*, a third sensor (third waste liquid sensor) 57*c*, a fourth sensor (fourth waste liquid sensor) 57*d*, a fifth sensor (fifth waste liquid sensor) 57*e*, and a sixth sensor (sixth waste liquid sensor) 57*f* for detecting the amount of waste ink accumulated in the waste liquid tank 13 are provided to the side of the waste liquid tank 13. In this embodiment, no full tank detecting sensor 45 is provided in the waste liquid tank 13. Further, in this embodiment, the first-sixth sensors 57*a*-57*f* are optical sensors.

A position Y, which is located between the position X and the position W, is added as another stop position (position in which the blade 21 is stopped) of the blade 21. Accordingly, the wiped off waste liquid falls to the positions P, Q and R inside the waste liquid tank 13.

In the control part 38 of the second embodiment, the receiving part 47 receives detection signals from the first-sixth sensors 57*a*-57*f*. In the second embodiment, there is no idle ejection counting part 49.

As illustrated in FIGS. 9 and 10, contacting parts 59 are provided on the first straight part 29 of the arm 23 for contacting the peripheral surface of the roller 15. The blade 21 is provided between the contact parts 59. The contact parts 59 project more toward the peripheral surface of the roller 15 than the blade 21. An elongated hole 60 is formed in the second straight part 31 of the arm 23 in a longitudinal direction. A first end 61 of the first straight part 29 is inserted into the elongated hole 60. The first end 61 is urged (pulled) toward the gear 27 by a coil spring (pulling spring) 63. In other words, the first end 61 is substantially pulled upward so that the contact part 59 is constantly pressed against the peripheral surface of the roller 15. Accordingly, the space (gap) M between the blade 21 and the peripheral surface of the roller 15 is substantially constant.

Next, an embodiment of an operation (flow) for controlling the idle ejection receiving part 17 is described with reference to FIG. 11. First, the determining part 51 determines whether a detection signal from the first sensor 57*a* is received by the receiving part 47 (Step S11). In a case where the determining part 51 determines that no detection signal from the first sensor 57*a* is received by the receiving part 47 (No in Step S1), the determining part 51 repeats determining whether a detection signal from the first sensor 57*a* is received by the receiving part 47 (Step S11). In a case where the determining part 51 determines that the detection signal is received (Yes in Step S11), the processing part 53 moves the blade 21 from the position X to the position W by rotating the first stepping motor 37 in a forward direction (Step S12). Then, the determining part 51 determines whether a detection signal from the second sensor 57*b* is received by the receiving part 47 (Step S13). In a case where the determining part 51 determines that the detection signal is received (Yes in Step S13), the processing part 53 moves the blade 21 from the position W to the position Y by rotating the first stepping motor 37 in a reverse direction (Step S14). In a case where the determining part 51 determines that no detection signal from the first sensor 57*a* is received by the receiving part 47 (No in Step S11), the determining part 51 repeats determining whether a detection signal from the second sensor 57*b* is received by the receiving part 47 (Step S13). Then, the determining part 51 determines whether a detection signal from the third sensor 57*c* is received by the receiving part 47 (Step S15). In a case where the determining part 51 determines that no detection signal from the third sensor 57*c* is received by the receiving part 47 (No in Step S15), the determining part 51 repeats determining whether a detection signal from the third sensor 57*b* is received by the receiving part 47 (Step S15). In a case where the determining part 51 determines that the detection signal is received (Yes in Step S15), the processing part 53 moves the blade 21 from the position Y to the position X by rotating the first stepping motor 37 in a reverse direction (Step S16). Then, the determining part 51 determines whether a detection signal from the fourth sensor 57*d* is received by the receiving part 47 (Step S17). In a case where the determining part 51 determines that no detection signal from the fourth sensor 57*d* is received by the receiving part 47 (No in Step S17), the determining part 51 repeats determining whether a detection signal from the fourth sensor 57*d* is received by the receiving part 47 (Step S17). In a case where the determining part 51 determines that the detection signal is received (Yes in Step S17), the processing part 53 moves the blade 21 from the position X to the position W by rotating the first stepping motor 37 in a forward direction (Step S18). Then, the determining part 51 determines whether a detection signal from the fifth sensor 57*e* is received by the receiving part 47 (Step S19). In a case where the determining part 51 determines that no detection signal from the fifth sensor 57*e* is received by the receiving part 47 (No in Step S19), the determining part 51 repeats determining whether a detection signal from the fifth sensor 57*e* is received by the receiving part 47 (Step S19). In a case where the determining part 51 determines that the detection signal is received (Yes in Step S19), the processing part 53 moves the blade 21 from the position W to the position Y by rotating the first stepping motor 37 in a reverse direction (Step S20). Then, the determining part 51 determines whether a detection signal from the sixth sensor 57*f* is received by the receiving part 47 (Step S21). In a case where the determining part 51 determines that the detection signal is received (Yes in Step S21), the processing part 53 terminates the operation of FIG. 11. In a case where the determining part 51 determines that no detection signal from the sixth sensor 57*f* is received by the receiving part 47 (No in Step S21), the determining part 51 repeats determining whether a detection signal from the sixth sensor 57*e* is received by the receiving part 47 (Step S21).

With the above-described embodiment of the present invention, the waste ink can be automatically prevented from accumulating at a certain part in the waste liquid tank 13 by changing the position of the blade 21 when the waste ink collected in the waste liquid tank 13 exceeds a predetermined amount.

With the above-described embodiment of the present invention, since the blade 21 can be moved in a direction (direction moving from position X to position W) opposite to the rotating direction (U direction) of the roller 15 during the rotation of the roller 15, the relative rate (speed) between the blade 21 and the peripheral surface of the roller 15 can be increased. Thus, the waste ink firmly adhered to the peripheral surface of the roller 15 can be wiped off effectively.

With the above-described embodiment of the present invention, because the blade 21 can be moved by directly detecting the amount of ink accumulated in the waste liquid tank 13, the waste ink can be consistently prevented from accumulating at a certain part in the waste liquid tank 13 without being influenced by conditions such as the viscosity of ink, the frequency (number of times) for executing the idle ejection operation, or operating environment conditions of the inkjet head 7 (e.g., temperature, humidity).

By having the contact parts 59 contact the peripheral surface of the roller 15, the space (gap) M between the blade and the peripheral surface of the roller 15 can be constant. Thus, the amount of change of the resistance between the peripheral surface of the roller 15 and the blade 21 during the waste ink wiping operation can be reduced. Accordingly, because the amount of load applied to the first driving part 20 can be stabilized, a substantially constant amount of waste ink can be consistently wiped.

By increasing the number of stop positions of the blade 21, the areas in the waste liquid tank 13 where the waste ink accumulate can be balanced. Thus, the capacity (space) of the waste liquid tank 13 can be used efficiently.

Third Embodiment

Figure 12:
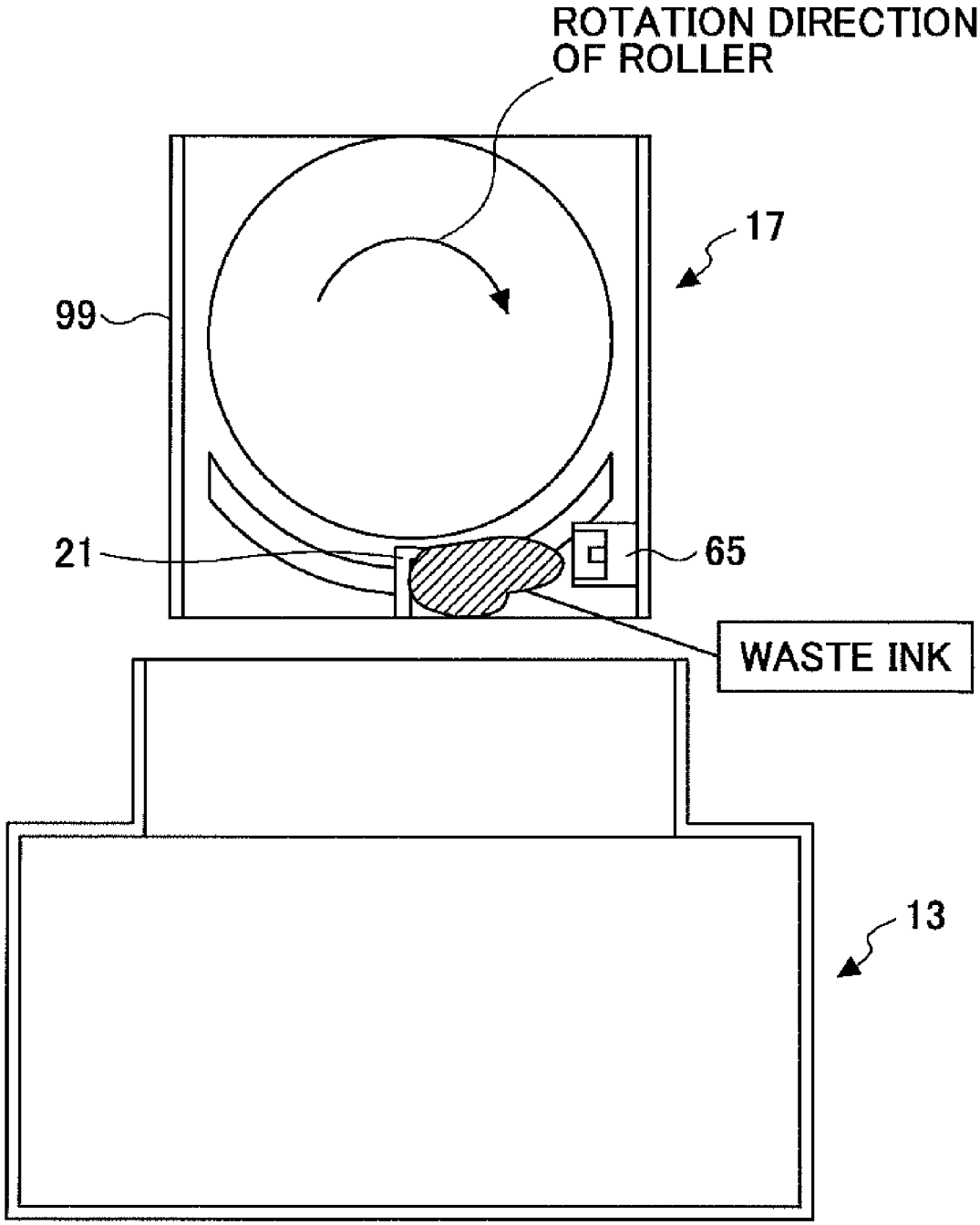
FIG. 12 is a vertical cross-sectional diagram for describing an idle ejection receiving part and a waste liquid tank of an image recording apparatus according to the third embodiment of the present invention.
Figure 13A:
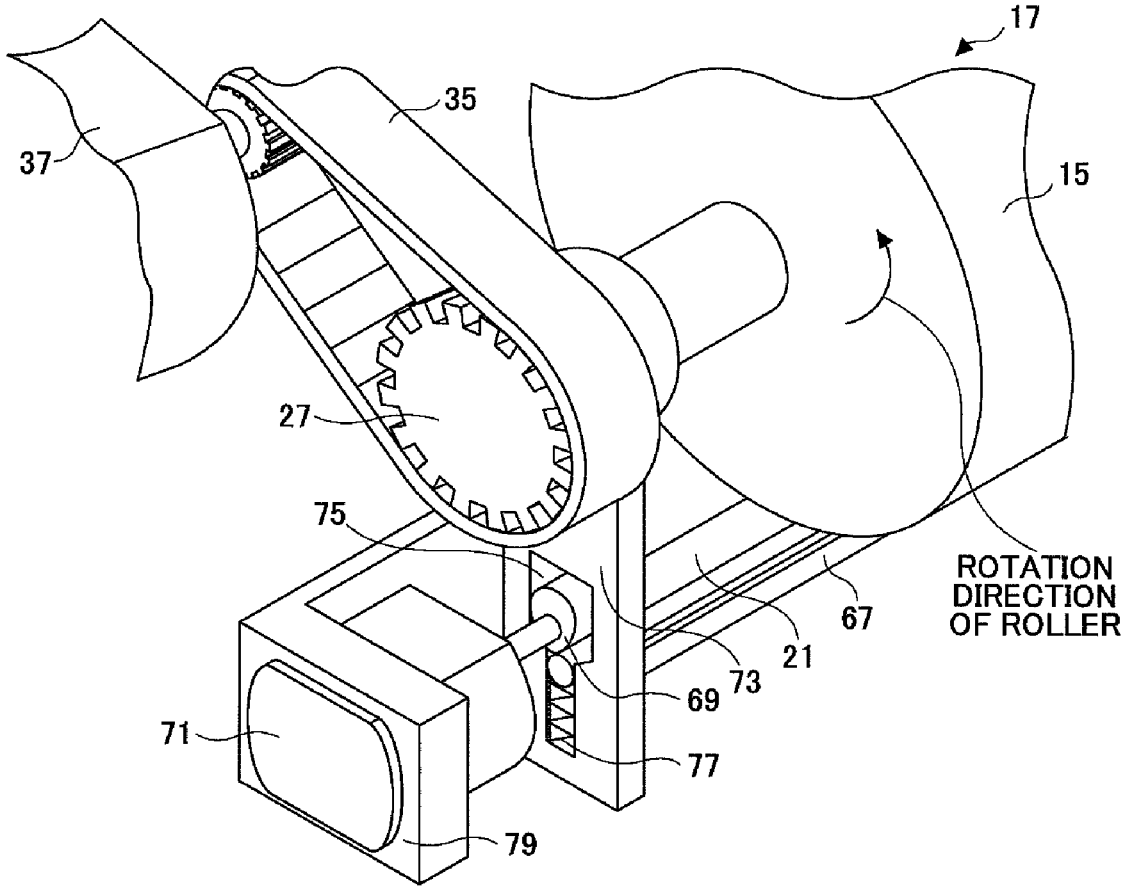
FIG. 13A is a perspective view for describing a regular state of the space (gap) between the peripheral surface of a roller and a blade that are around a third driving part according to the third embodiment of the present invention.
Figure 13B:
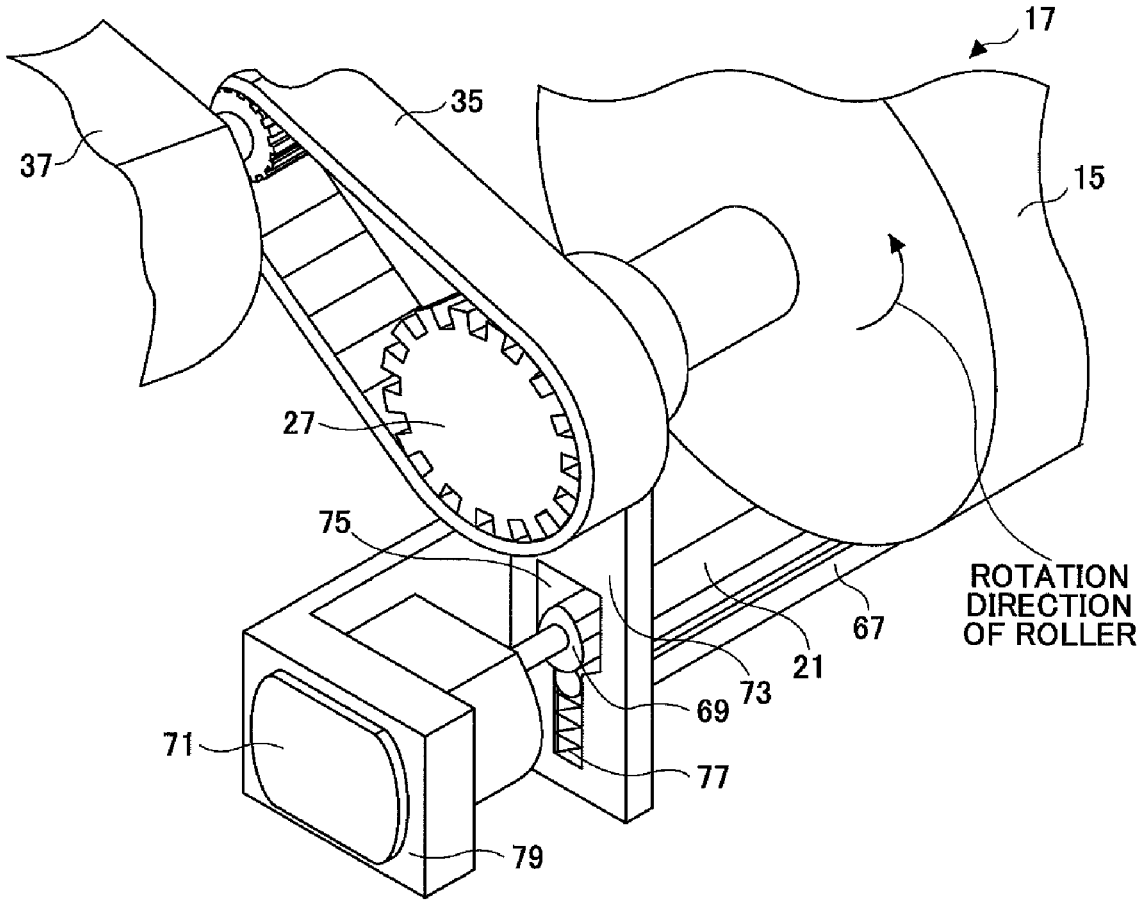
FIG. 13B is a perspective view for describing a widened state of the space (gap) between the peripheral surface of the roller and the blade that are around a third driving part according to the third embodiment of the present invention.
Figure 14A:
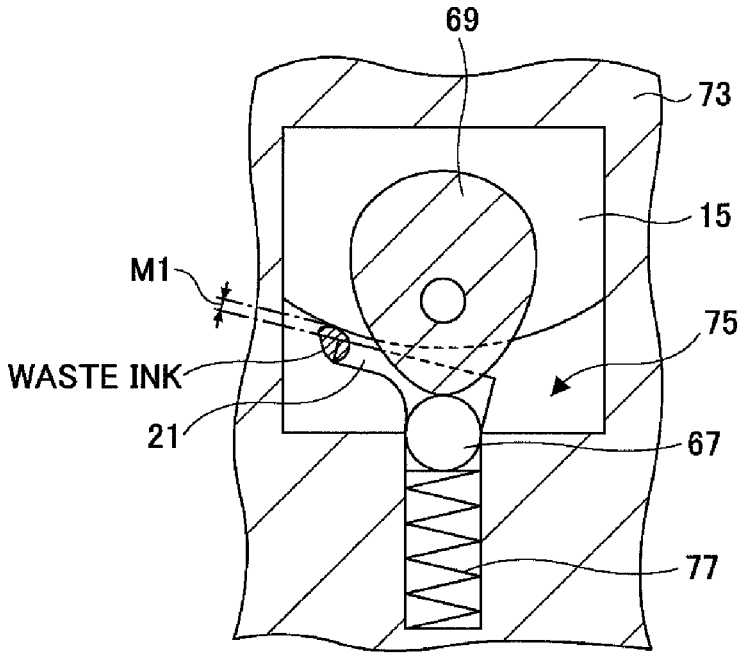
FIG. 14A is a vertical cross-sectional diagram for describing a regular state of the space (gap) between the peripheral surface of a roller and a blade that surround a third driving part according to the third embodiment of the present invention.
Figure 14B:
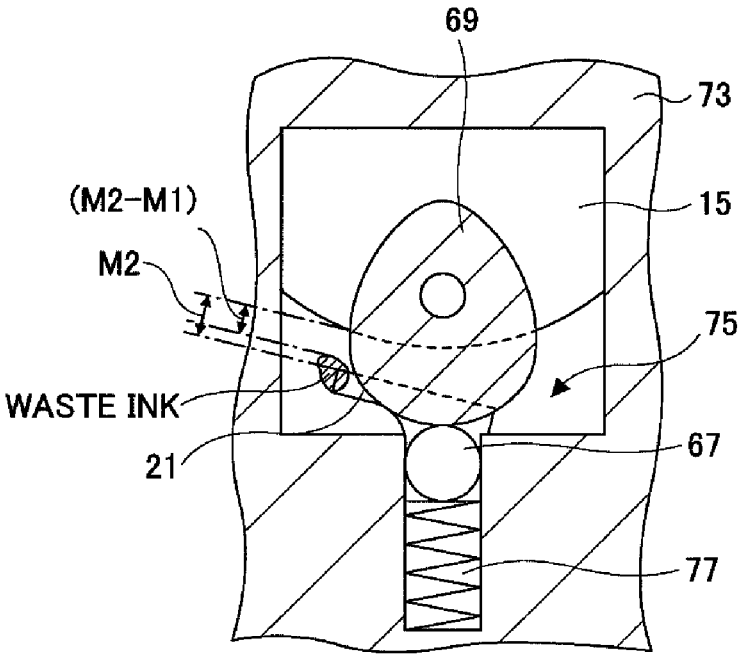
FIG. 14B is a vertical cross-sectional diagram for describing the widened state of the space (gap) between the peripheral surface of a roller and a blade that are near the third driving part according to the third embodiment of the present invention.
Figure 15:
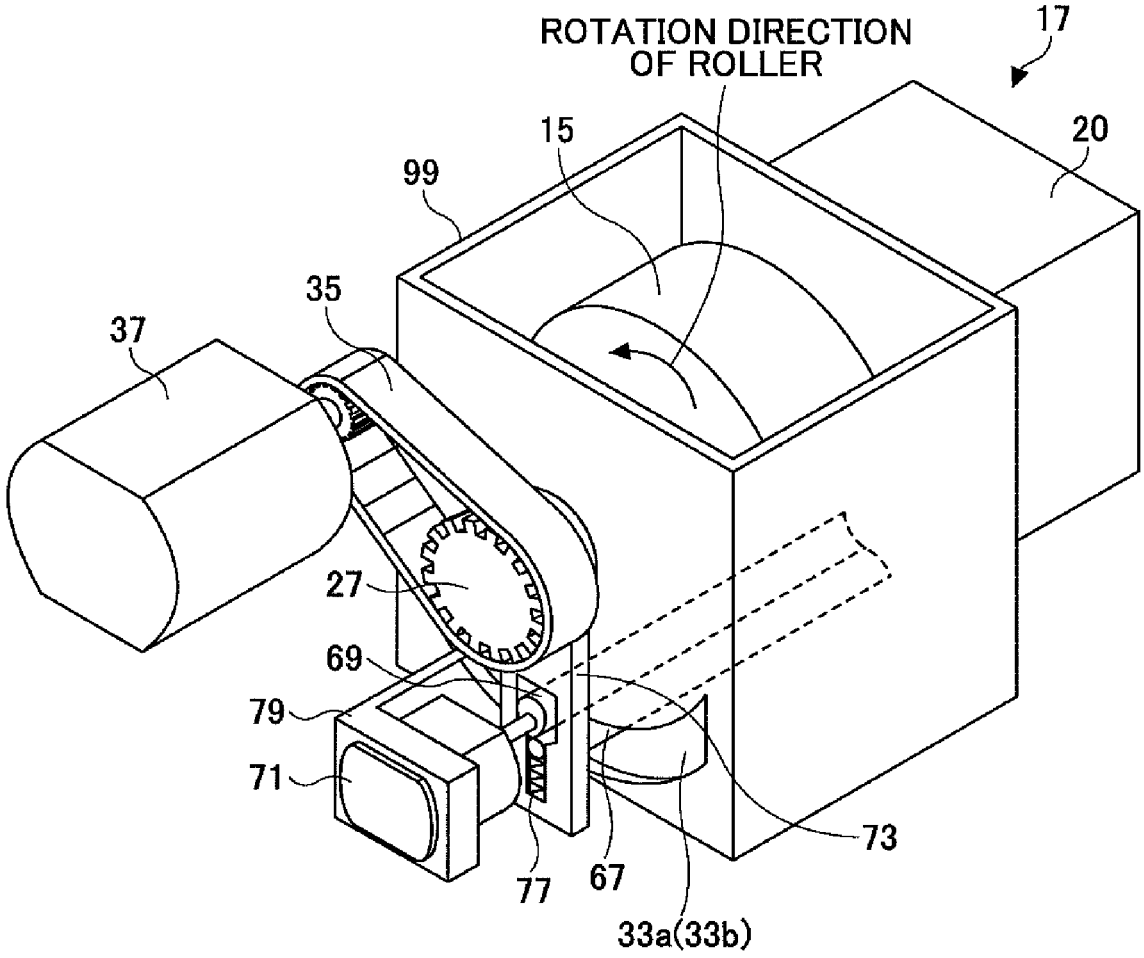
FIG. 15 is a perspective view illustrating a configuration of an idle ejection receiving part according to the third embodiment of the present invention.
Figure 16:
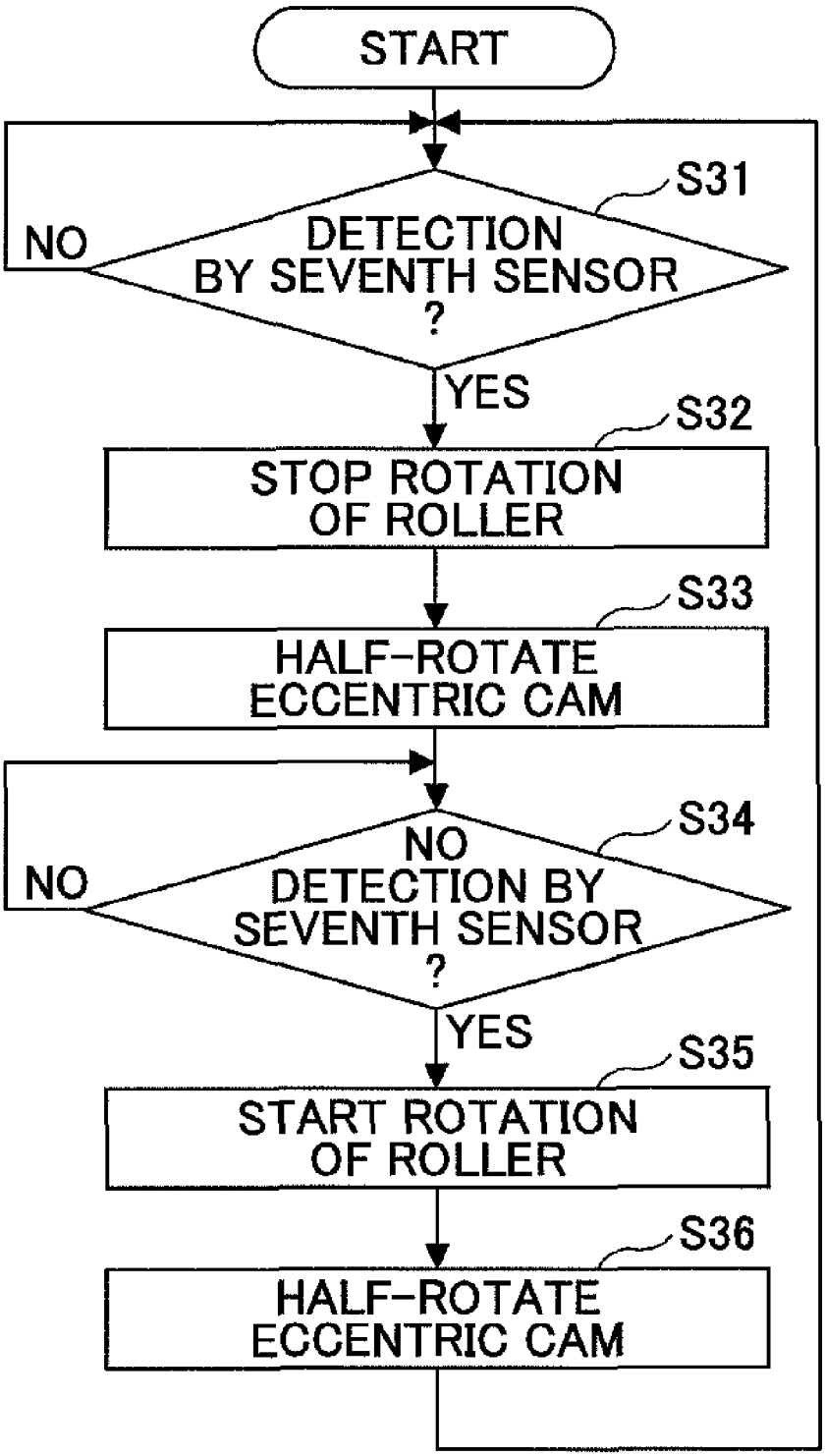
FIG. 16 is a flowchart illustrating an operation (flow) for controlling an idle ejection receiving part according to the third embodiment of the present invention.

Next, an image recording apparatus according to a third embodiment of the present invention is described with reference to FIGS. 12-16. In the third embodiment, like components are denoted by like reference numerals as of the first and second embodiments and are not further described. FIG. 12 is a vertical cross-sectional diagram for describing the idle ejection receiving part 17 and the waste liquid tank 13 of the image recording apparatus 1 according to the third embodiment of the present invention. FIG. 13A is a perspective view for describing a regular state of the space (gap) between the peripheral surface of the roller 15 and the blade 21 that are around a third driving part 71 according to the third embodiment of the present invention. FIG. 13B is a perspective view for describing a widened state of the space (gap) between the peripheral surface of the roller 15 and the blade 21 that are around a third driving part 71 according to the third embodiment of the present invention. FIG. 14A is a vertical cross-sectional diagram for describing a regular state of the space (gap) between the peripheral surface of the roller 15 and the blade 21 that surround a third driving part 71 according to the third embodiment of the present invention. FIG. 14B is a vertical cross-sectional diagram for describing the widened state of the space (gap) between the peripheral surface of the roller 15 and the blade 21 that are near the third driving part 71 according to the third embodiment of the present invention. FIG. 15 is a perspective view illustrating a configuration of the idle ejection receiving part 17 according to the third embodiment of the present invention. FIG. 16 is a flowchart illustrating an operation (flow) for controlling the idle ejection receiving part 17 according to the third embodiment of the present invention.

In the third embodiment, a seventh sensor (second waste liquid sensor) 65 for detecting the amount of waste ink adhered to the blade 21 is provided to an inner surface of the housing 99 of the idle ejection receiving part 17 as illustrated in FIG. 12. The seventh sensor 65 is placed at a position capable of detecting the amount of waste ink when the waste ink adhered to the blade 21 fills the space (gap) M1 between the peripheral surface of the roller 15 and the blade 21. The seventh sensor 65 is connected to the receiving part 47.

As illustrated in FIGS. 13A, 13B, and FIG. 15, the blade 21 is fixed to a straight arm 67. The arm 67 is positioned extending in the direction of the axle 50 of the roller 15 and facing the peripheral surface of the roller 15. The arm 67 has a peripheral surface contacting a cam surface of an eccentric cam 69 fixed to a driving axle of a second stepping motor (hereinafter also referred to as "third driving part") 71.

The arm 67 has a first end part supported by a planar supporting member 73. As illustrated in FIGS. 14A and 14B, the supporting member 73 has a substantially T-shaped notch part 75. From the top part of the notch part 75, the eccentric cam 69, the first end part of the arm 67, and a coil spring (compression spring) 77 are inserted in the notch part 75 in this order. The first end part of the arm 67 is urged (pressed) toward the cam surface of the eccentric cam 69. Thereby, the arm 67 can trace (follow) the cam surface of the eccentric cam 69 when the eccentric cam 69 is rotated.

That is, by rotating the eccentric cam 69 by driving the second stepping motor 71, the gap (space) M between the blade 21 and the peripheral surface of the roller 15 can be freely adjusted between a gap (space) M1 and a gap (space) M2 (M2>M1) as illustrated in FIGS. 14A and 14B.

The gear 27 is fixed to one end of the supporting member 73. The supporting member 73 is configured to oscillate in correspondence with the rotation of the gear 27.

The second stepping motor 71 is fixed to a holder 79. The holder 79 is fixed to the supporting member 73. That is, the second stepping motor 71 is configured to move along the peripheral direction of the roller 15 in correspondence with the oscillation of the supporting member 73.

Next, the movement and controls for the idle ejection receiving part 17 according to the third embodiment of the present invention are described with reference to FIGS. 14A, 14B, and 16. First, contact between the arm 67 and the eccentric cam 69 is illustrated in FIG. 14A. In FIG. 14A, the gap (space) between the peripheral surface of the roller 15 and the blade 21 is indicated as "M1". Accordingly, first, in the operation for controlling the idle ejection receiving part 17 according to the third embodiment of the present invention, the determining part 51 determines whether a detection signal from the seventh sensor 65 is received by the receiving part 47 (Step S31). In a case where the determining part 51 determines that no detection signal from the seventh sensor 65 is received by the receiving part 47 (No in Step S31), the determining part 51 repeats determining whether a detection signal from the seventh sensor 65 is received by the receiving part 47 (Step S31). In a case where the determining part 51 determines that the detection signal is received (Yes in Step S31), after the processing part 53 stops the rotation of the roller 15 (Step S32), the processing part 53 rotates the eccentric cam 69 halfway (half-rotation) by driving the second stepping motor 71 (Step S33). The contact between the arm 67 and the eccentric cam 69 during this step is illustrated in FIG. 14B. That is, the space between the peripheral surface of the roller 15 and the blade 21 is widened from M1 to M2, to thereby increasing by (M2−M1) the gap between the peripheral surface of the roller 15 and the blade 21. Then, the determining part 51 determines whether a non-detection signal from the seventh sensor 65 is received by the receiving part 47 (Step S34). In this embodiment, the "non-detection signal" is a signal that is output when the seventh detecting sensor 65 changes (transfers) from a detecting (detectable) state to a non-detecting (non-detectable) state. In a case where the determining part 51 determines that the non-detection signal is received (Yes in Step S34), after the processing part 53 starts the rotation of the roller 15 (Step S35), the processing part 53 rotates the eccentric cam 69 halfway (half-rotation) by driving the second stepping motor 71 (Step S36). The contact between the arm 67 and the eccentric cam 69 during this step is illustrated in FIG. 14A. That is, the space between the peripheral surface of the roller 15 and the blade 21 becomes M1. Then, the operation of FIG. 16 returns to Step S31. In a case where the determining part 51 determines that no non-detection signal is received by the receiving part 47 (No in Step S34), the determining part 51 repeats determining whether a non-detection signal is received by the receiving part 47 (Step S34).

With the above-described embodiment of the present invention, the waste ink adhered to the blade 21 can be prevented from obstructing the rotation of the roller 15 by widening (adjusting) the gap between the peripheral surface of the roller 15 and the blade 21. Accordingly, damaging of the first driving part 20 due to excessive load applied to the first driving part 20 can be prevented.

Since the gap between the peripheral surface of the roller 15 and the blade 21 can be widened when the amount of waste ink adhered to the blade 21 of the idle ejection receiving part 17 becomes no less than a predetermined amount, the waste ink adhered to the blade 21 can be automatically prevented from obstructing the rotation of the roller 15. Accordingly, damaging of the first driving part 20 due to excessive load applied to the first driving part 20 can be prevented.

The present invention is not limited to the specifically disclosed embodiments, and variations and modifications may be made without departing from the scope of the present invention.

For example, the first embodiment is not limited to the blade 21 being moved whenever the idle ejection operation is executed 10 times. That is, the blade 21 may be moved in accordance with other conditions such as ink viscosity or the operating environment of the inkjet head 7. For example, the blade 21 may be moved whenever the idle ejection operation is executed 5 times where the ink has a viscosity higher than a predetermined viscosity or where the humidity (solvent density of the waste ink inside the waste liquid tank) is higher than a predetermined humidity.

In the first embodiment, although the blade 21 made of metal is arranged having a predetermined gap M with respect to the peripheral surface of the roller 15, the blade 21 may be formed with other materials for contacting the peripheral surface of the roller 15 such as a resin material.

In the second embodiment, although the blade 21 is moved in a direction opposite to the rotating direction of the roller 15 when the amount of waste ink accumulated in the waste liquid tank 13 reaches a predetermined amount, the blade 21 may be moved after a predetermined time elapses from the previous time of executing the idle ejection operation (in this case, a timer and a storing part for storing the time of the idle ejection are provided to the image recording apparatus 1). Even where waste ink is firmly adhered to the roller 15 after a predetermined time elapses, the waste ink can be positively wiped off.

In the second embodiment, although the rotation of the roller 15 is substantially constant, the roller 15 may be configured to rotate in a direction opposite to the moving direction of the blade 21 during the moving of the blade 21.

In the third embodiment, although the gap M between the peripheral surface of the roller 15 and the blade 21 is widened when the seventh sensor 65 becomes a detected state, the blade 21 may be moved in a direction opposite to the rotating direction of the roller 15 during the rotation of the roller 15 when the seventh sensor 65 becomes a detected state. Accordingly, the waste ink firmly adhered to the blade 21 can be positively wiped off without having to apply excessive load to the first driving part 20.

In the third embodiment, although the gap M between the peripheral surface of the roller 15 and the blade 21 is widened when the seventh sensor 65 becomes a detected state, the widening process may be replaced or performed together with widening the gap M between the peripheral surface of the roller 15 and the blade 21 after a predetermined time elapses after a previous idle ejection operation (by using a timer and a storing part for storing the time of the idle ejection operation). Accordingly, the waste ink adhered to the blade 21 can be automatically prevented from obstructing the rotation of the roller 15. Accordingly, damaging of the first driving part 20 due to excessive load applied to the first driving part 20 can be automatically prevented.

In one of the above-described embodiments, although the rotating rate (speed) of the roller 15 is substantially constant, the rotating rate (speed) of the roller 15 may be periodically controlled for a predetermined time. For example, by increasing the relative speed between the peripheral surface of the roller 15 and the blade 21, the waste ink firmly adhered to the blade 21 or the peripheral surface of the roller 15 can be positively wiped off.

In the above-described embodiments, the idle ejection receiving part 17 may be provided to the discharge part at the lower part of the maintenance/recover unit 19.

Further, although the above-described embodiments are applied to a case of forming an image by ejecting ink (liquid) onto a sheet of paper (recording medium) T from an inkjet head 7, the embodiments may be applied to a case of fabricating an electronic circuit by ejecting a liquid having an amorphous silicon dissolved in a nitril based solvent.

In the above-described embodiments, although the image recording apparatus 1 is a printer, the image recording apparatus 1 may be other apparatuses such as a copier or a multifunction machine having the functions of a copier and an image processing apparatus.

The present invention is not limited to the specifically disclosed embodiments, and variations and modifications may be made without departing from the scope of the present invention.

The present application is based on Japanese Priority Application No. 2008-054336 filed Mar. 5, 2008, with the Japanese Patent Office, the entire contents of which are hereby incorporated herein by reference.

What is claimed is:

1. An image recording apparatus including an idle ejection receiving part for receiving idle-ejected waste liquid from a liquid jet head and a waste liquid tank provided below the idle ejection receiving part for collecting the waste liquid dropping from the idle ejection receiving part, the image recording apparatus comprising:

a roller rotating around a driving axle having a peripheral surface for rotating and receiving the waste liquid;

a wiping member that contacts or faces the peripheral surface for wiping the waste liquid on the peripheral surface of the rotating member, the wiping member including an L-shaped arm having a first straight part and a second straight part, the first straight part being connected to one end of the second straight part and perpendicularly intersected by the second straight part, a blade attached to the first straight part of the L-shaped arm, and a gear attached to the driving axle provided at a center part of the roller, the other end of the second straight part of the L-shaped arm being attached to the gear; and a control part configured to cause the blade to rotatably move around a center of the gear from a first position contacting the roller to a second position contacting the roller but different from the first position, along the peripheral surface of the roller wherein the L-shaped arm connects the blade to the gear, which is attached to the driving axle of the roller, and the roller leaned by the blade, and wherein, by rotating the roller in a state in which the blade is positioned at the first position, the peripheral surface of the roller is cleaned by the blade while causing waste liquid to fall to a first specific position of the waste liquid tank, and by rotating the roller in a state in which the blade is moved around the center of the gear of the roller to the second position, the peripheral surface of the roller is cleaned by the blade while causing the waste liquid to fall to a second specific position of the waste liquid tank.

2. The image recording apparatus as claimed in claim 1, further comprising:

a first waste liquid sensor for detecting an amount of the waste ink accumulated in the waste liquid tank;

wherein the wiping member is configured to change position when the detected amount of the waste ink accumulated in the waste liquid tank is not less than a predetermined amount.

3. The image recording apparatus as claimed in claim 1, further comprising:

an idle ejection counting part configured to count the number of times an idle ejection operation is executed by the liquid jet head;

wherein the control part causes the blade to move from the first position to the second position, when the counted number of times the idle ejection operation is executed by the liquid jet head reaches a predetermined number of times.

4. The image recording apparatus as claimed in claim 1 wherein the blade is configured to move in a direction opposite to a rotating direction of the roller while the roller is rotating.

5. The image recording apparatus as claimed in claim 2, further comprising:

a second waste liquid sensor for detecting an amount of the waste ink adhered to the idle ejection receiving part;

wherein the wiping member is configured to move in a direction opposite to a rotating direction of the rotating member while the rotating member is rotating when the detected amount of the waste ink adhered to the idle ejection receiving part is no less than a predetermined amount.

6. The image recording apparatus as claimed in claim 1, wherein the wiping member includes a contacting part, the contacting part contacting the peripheral surface of the roller and projecting more toward the peripheral surface of the roller than the blade.

7. The image recording apparatus as claimed in claim 1, wherein the wiping member is configured to move along a radial direction of the rotating member.

8. The image recording apparatus as claimed in claim 2, further comprising:

a second waste liquid sensor for detecting an amount of the waste ink adhered to the idle ejection receiving part;

wherein the wiping member is configured to widen a gap between the peripheral surface of the rotating member when the detected amount of the waste ink adhered to the idle ejection receiving part is not less than a predetermined amount.

9. The image recording apparatus as claimed in claim 1, wherein the control part causes the blade to move between the first position and the second position, based on the number of times an idle ejection operation has been executed by the liquid jet head.

10. The image recording apparatus as claimed in claim 1, wherein the blade is caused to move from the first position to the second position, when the control pan determines that an idle ejection operation has been executed a predetermined number of times by the liquid jet head while the blade is at the first position, and the blade is caused to move from the second position to the first position, when the control part determines that the idle ejection operation has been executed a predetermined number of times by the liquid jet head while the blade is at the second position.

11. The image recording apparatus as claimed in claim 1, wherein the control part causes the wiping member to move between the first position and the second position, based on a detected viscosity level of the waste liquid.

12. The image recording apparatus claimed in claim 1, wherein when the control part determines that a detected viscosity level of the waste ink is less than or equal to a predetermined viscosity threshold, then the control part causes the wiping member to move from the first position to the second position after an idle ejection operation has been executed by the liquid jet head a first predetermined number of times, and if the control part determines that the detected viscosity level of the waste ink is greater than the predetermined viscosity threshold, then the control part causes the wiping member to move from the first position to the second position after the idle ejection operation has been executed by the liquid jet head a second predetermined number of times.

13. The image recording apparatus as claimed in claim 1, wherein the control part causes the wiping member to move between the first position and the second position, based on a detected humidity level of the waste liquid tank.

14. The image recording apparatus as claimed in claim 1, wherein when the control part determines that a detected humidity level of the waste ink is less than or equal to a predetermined humidity threshold, then the control part causes the wiping member to move from the first position to the second position after an idle ejection operation has been executed by the liquid jet head a first predetermined number of times, and when the control part determines that the detected humidity level of the waste ink is greater than the predetermined humidity threshold, then the control part causes the wiping member to move from the first position to the second position after the idle ejection operation has been executed by the liquid jet head a second predetermined number of times.

15. A method for receiving idle-ejected waste liquid ejected from a liquid jet head of an image recording apparatus, wherein the image recording apparatus includes a wiping member including an L-shaped arm having a first straight part and a second straight part, the first straight part being connected to one end of the second straight part and perpendicularly intersected by the second straight part, a blade attached to the first straight part of the L-shaped arm, and a gear attached to a driving axle provided at a center part of a roller positioned under the liquid jet head, the other end of the second straight part of the L-shaped arm being attached to the gear, and wherein the L-shaped arm connects the blade to the gear, which is attached to the driving axle of the roller the roller being cleaned by the blade, the method comprising:

rotating the roller around the driving axle, and receiving the waste liquid on a peripheral surface of the roller;

contacting the blade with the peripheral surface of the roller to wipe the waste liquid on the peripheral surface of the roller; and causing the blade to rotatably move around a center of the gear from a position contacting the roller to a second position contacting the roller but different from the first position, along the peripheral surface of the roller rotating the roller in a state in which the blade is positioned at the first position to clean the peripheral surface of the roller, and causing waste liquid to fall to a first specific position of a waste liquid tank; and rotating the roller in a state in which the blade is moved around the center of the gear of the roller to the second position to clean the peripheral surface of the roller, and causing the waste liquid to fall to a second specific position of the waste liquid tank.

16. The image recording apparatus as claimed in claim 1, further comprising a driving part that moves, under control of the control part, the blade between the first position and the second position, along the peripheral surface of the roller.

* * * * *